US009585200B2

(12) United States Patent
Christiansen et al.

(10) Patent No.: US 9,585,200 B2
(45) Date of Patent: Feb. 28, 2017

(54) METHOD FOR ASSIGNING INDUCTION COILS OF AN INDUCTION COOKING HOB AND AN INDUCTION COOKING HOB

(71) Applicant: Electrolux Appliances Aktiebolag, Stockholm (SE)

(72) Inventors: Svend Erik Christiansen, Forli (IT); Andrea Fattorini, Forli (IT); Laurent Jeanneteau, Forli (IT); Alex Viroli, Forli (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 0 days.

(21) Appl. No.: 14/770,993

(22) PCT Filed: Mar. 11, 2014

(86) PCT No.: PCT/EP2014/054672

§ 371 (c)(1),
(2) Date: Aug. 27, 2015

(87) PCT Pub. No.: WO2014/139996

PCT Pub. Date: Sep. 18, 2014

(65) Prior Publication Data

US 2016/0037585 A1 Feb. 4, 2016

(30) Foreign Application Priority Data

Mar. 11, 2013 (EP) ..... 13158556

(51) Int. Cl.
*H05B 6/06* (2006.01)
*H05B 6/12* (2006.01)

(52) U.S. Cl.
CPC ..... *H05B 6/065* (2013.01); *H05B 6/1209* (2013.01); *H05B 2206/02* (2013.01); *H05B 2213/03* (2013.01); *H05B 2213/05* (2013.01)

(58) Field of Classification Search
CPC .. H05B 6/065; H05B 6/1209; H05B 2213/03; H05B 2206/02; H05B 2213/05
(Continued)

(56) References Cited

U.S. PATENT DOCUMENTS

2004/0218591 A1 11/2004 Ogawa
2007/0215605 A1 9/2007 Baier
(Continued)

FOREIGN PATENT DOCUMENTS

CN 101426310 A 5/2009
CN 102232164 A 11/2011
(Continued)

OTHER PUBLICATIONS

International Search Report issued in Application No. PCT/EP2014/054672 dated May 9, 2014.
(Continued)

*Primary Examiner* — Quang Van
(74) *Attorney, Agent, or Firm* — Pearne & Gordon LLP

(57) ABSTRACT

An induction cooking hob and method for assigning induction coils of the hob, so that each coil corresponds with a unique number or identity. The method includes; setting a load onto the hob, so that the load covers only one of the coils, which is provided for a first unique number or first identity; activating a pot detection device for all coils of hob; identifying the coil covered by the load; assigning the first number or identity to the covered coil; storing the unique number or identity in conjunction with the covered induction coil; setting the load onto a further one of the coils, which is provided for a second unique number or second identity; repeating the steps c) to f) for the further coil and second number or identity; and repeating the steps b) to f) for all other coils and corresponding unique numbers or corresponding identities.

14 Claims, 2 Drawing Sheets

(58) Field of Classification Search
USPC ..... 219/626, 620, 621, 622, 662, 650, 655, 219/671, 600, 627, 665, 412, 414, 494; 426/231
See application file for complete search history.

(56) References Cited

U.S. PATENT DOCUMENTS

| | | | | |
|---|---|---|---|---|
| 2009/0101638 | A1 | 4/2009 | Niederer | |
| 2011/0226753 | A1* | 9/2011 | Casanova Lacueva | F24C 7/083 219/462.1 |
| 2012/0321762 | A1 | 12/2012 | Aranda Vazquez | |

FOREIGN PATENT DOCUMENTS

| | | | |
|---|---|---|---|
| CN | 102783247 | A | 11/2012 |
| EP | 2 034 800 | A1 | 3/2009 |

OTHER PUBLICATIONS

Office action issued in corresponding Chinese Patent Application No. 201480013333.6 dated Oct. 24, 2016, 8 pages.

* cited by examiner

METHOD FOR ASSIGNING INDUCTION COILS OF AN INDUCTION COOKING HOB AND AN INDUCTION COOKING HOB

The present invention relates to a method for assigning induction coils of an induction cooking hob. Further, the present invention relates to an induction cooking hob.

In an induction cooking hob each induction coil has to be connected to a control unit and/or to a power supply via a dedicated connector. In particular, in an induction cooking hob with a plurality of induction coils the wiring becomes complex and prone to errors, since each induction coil has to be connected to the dedicated connector. For example, the induction cooking hob may include about 50 induction coils. It would be advantageous to avoid the dedicated connectors and to reduce the complexity of the wiring.

Figure 3:
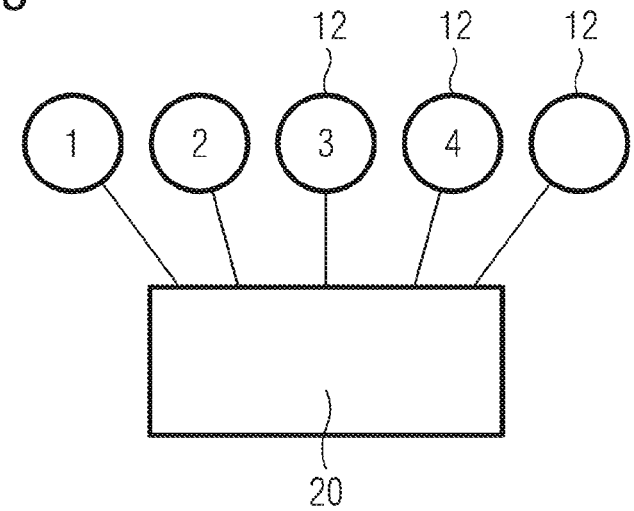

FIG. 3 illustrates a schematic circuit diagram of the induction cooking hob 10 according to the prior art. The induction coils 12 of the induction cooking hob 10 are directly connected to the control unit 20. Each induction coil 12 has to be connected to the dedicated connector. With a high number of induction coils 12 wiring becomes complex and prone to errors.

It is an object of the present invention to provide a method for assigning induction coils of an induction cooking hob and an induction cooking hob, which overcomes the above problems.

The object of the present invention is achieved by the method according to claim 1.

The present invention relates to a method for assigning a plurality of induction coils of an induction cooking hob, so that each induction coil corresponds with a unique number or an identity, wherein said method comprises the steps of:

a) providing the assembled induction cooking hob,
b) setting a load onto the induction cooking hob, so that the load covers only one of the induction coils, which is provided for a first unique number or first identity, respectively,
c) activating a pot detection device for all induction coils of the induction cooking hob,
d) identifying the induction coil covered by the load,
e) assigning the first unique number or first identity, respectively, to the covered induction coil,
f) storing the first unique number or first identity, respectively, in conjunction with the covered induction coil,
g) setting the load onto a further one of the induction coils, which is provided for a second unique number or second identity, respectively,
h) repeating the steps c) to f) for the further induction coil and second unique number or second identity, respectively, and
i) repeating the steps b) to f) for all other induction coils and corresponding unique numbers or corresponding identities, respectively.

The core of the method according to the present invention is that the components of the assembled induction cooking hob are interconnected by hardware, but the induction coils are assigned by software implementation. The assignment of the induction coils is usually a singular process. The association between the induction coils and the unique numbers or identities may be selected by the producer as the end of the assembling process or by the user. The assignment is independent of the wiring and requires no connection to a dedicated connector. A different geographical induction coil assembly or configuration may be associated to a specific sequence of the load.

For example, the load is a metal disk or a cooking vessel.

Preferably, the area of the load has the same size as the induction coil.

The object of the present invention is further achieved by the induction cooking hob according to claim 4.

The present invention relates to an induction cooking hob with a plurality of induction coils and a control system, wherein:

the control system includes a control unit and a pot detection device,
the pot detection device is provided for detecting a load covering the induction coil,
the control unit is provided for identifying the induction coil covered by the load,
the control unit is provided for assigning a predetermined unique number or identity to the covered induction coil,
the control unit is provided for storing the assigned unique number or identity, respectively, in conjunction with the covered induction coil, and
the control unit is provided for repeating the detection, identification, assigning and storing the unique numbers or identities, respectively, in conjunction with the corresponding induction coils covered by the load.

The main idea of the induction cooking hob according to the present invention is that the components of the assembled induction cooking hob are interconnected by hardware, but the induction coils are assigned by software implementation. The association between the induction coils and the unique numbers or identities may be selected by the producer as the end of the assembling process or by the user. The assignment is independent of the wiring and requires no connection to a dedicated connector.

Preferably, the induction cooking hob includes more than six induction coils.

Further, the induction cooking hob may include independent induction generators for driving the induction coils, wherein the induction generator is provided for driving one or more induction coils.

For example, the induction generator is a half-bridge inverter.

Moreover, the induction coils driven by one induction generator may be connected in series and/or in parallel.

In particular, the control system includes a communication bus connecting the control unit and the pot detection device.

Preferably, the communication bus connects the control unit to the induction generators.

A further communication bus may connect the control unit to a user interface.

In particular, the control system includes coordination means for synchronizing the induction generators.

For example, the coordination means are provided for synchronizing the induction generators, so that induction coils covered by the same cooking vessel are driven by the same frequency.

Further, the coordination means may be provided for synchronizing the induction generators, so that neighboured induction coils are driven by the same frequency.

At last, the induction cooking hob is provided for a method mentioned above.

Novel and inventive features believed to be the characteristic of the present invention are set forth in the appended claims.

Figure 1:
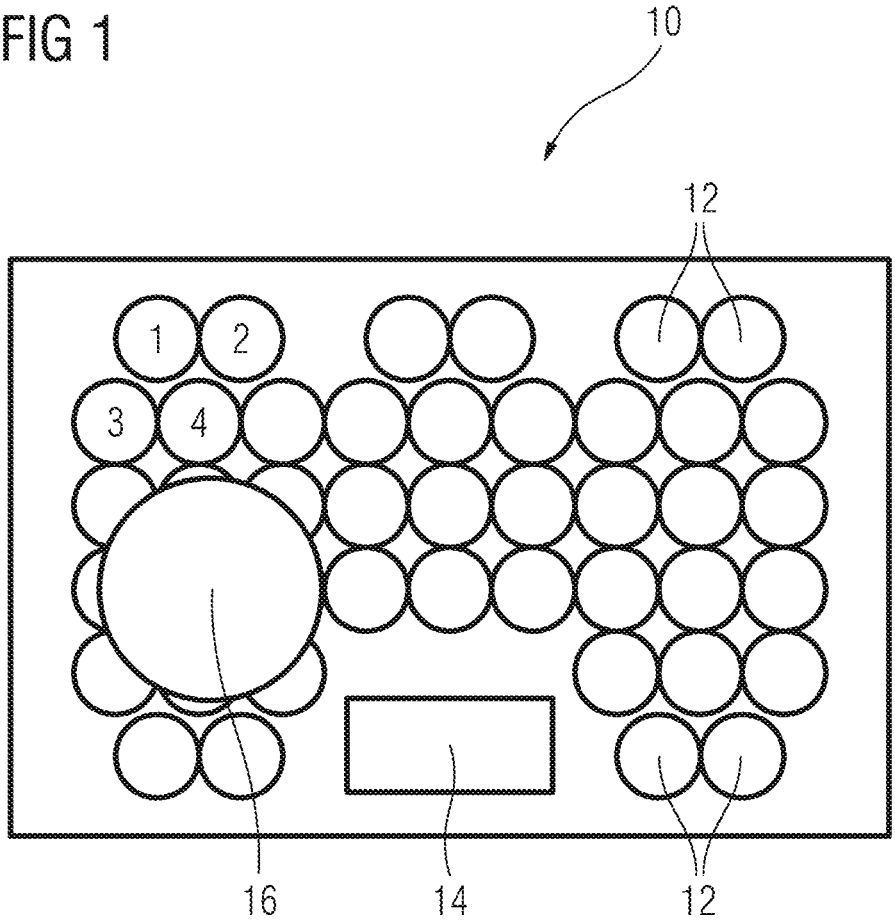
Figure 2:
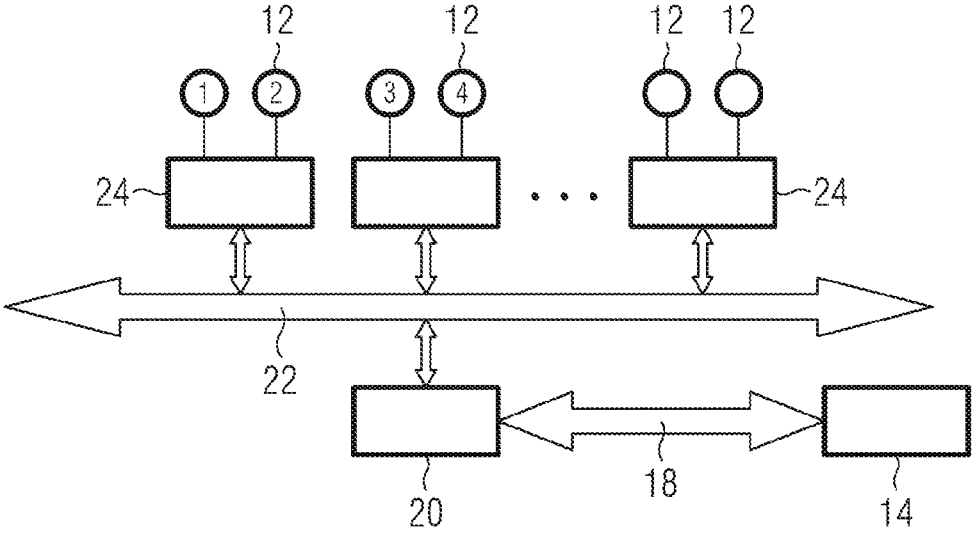

The invention will be described in further detail with reference to the drawings, in which FIG. 1 illustrates a top view of an induction cooking hob according to a preferred embodiment of the present invention, FIG. 2 illustrates a schematic circuit diagram of the induction cooking hob according to the preferred embodiment of the present invention, and FIG. 3 illustrates a schematic circuit diagram of the induction cooking hob according to the prior art.

FIG. 1 illustrates a top view of an induction cooking hob 10 according to a preferred embodiment of the present invention. The induction cooking hob 10 includes a plurality of induction coils 12 and a user interface 14.

The induction coils 12 are arranged as a matrix. Each induction coil 12 corresponds with a unique number or an identity. As an example, four induction coils 12 in FIG. 1 are enumerated by the numbers "1", "2", "3" and "4". The induction cooking hob 10 includes a pot detection device, wherein at least one sensor corresponds with one induction coil 12 in each case. The pot detection device is a part of a control system of the induction cooking hob 10. For example, the induction coils 12 may be also used as pot detection sensors.

A cooking vessel 16 is placed on the induction cooking hob 10. In this example, the cooking vessel 16 covers at least partially nine induction coils 12. In general, the cooking vessel 16 may be placed above the induction coils 12 in an arbitrary position of the induction cooking hob 10.

FIG. 2 illustrates a schematic circuit diagram of the induction cooking hob 10 according to the preferred embodiment of the present invention.

The induction cooking hob 10 comprises a control unit 20 as a central device. The control unit 20 is also a part of the control system of the induction cooking hob 10. For example, the control unit 20 includes one or more microprocessors or microcontrollers. The control unit 20 is connected to the user interface 14 via a first communication bus 18. Further, the control unit 20 is connected to a number of induction generators 24 via a second communication bus 22. The induction generators 24 are provided for driving the induction coils 12. In this example, one induction generator 24 drives two induction coils 12 in each case. In general, one induction generator 24 may drive one or more induction coils 12 in each case. The induction coils 12 driven by one induction generator 24 may be connected in series and/or in parallel. For example, the induction generator 24 is a half-bridge inverter.

The induction coils 12 are assembled in the induction cooking hob 10 and electrically connected in an arbitrary order. A special initialization mode is provided. A load covering only one induction coil 12 is placed on the induction cooking hob 10 in the beginning of the initialization mode. The load may be realized by a metal disk or a cooking vessel 16 or another metal device. That induction coil 12 is covered, which shall correspond with a first unique number or first identity. Then, pot detection is performed on all induction coils 12. The induction coil 12 covered by the load is identified by the control unit 20. The identified induction coil 12 is assigned by the first unique number or first identity, respectively. This information is stored in a non-volatile memory of the control unit 20.

Then, the load covers another induction coil 12, which shall correspond with a second unique number or second identity. The above procedure is repeated for the induction coil 12 corresponding with the second unique number or second identity.

Further, the above procedure is performed for all other induction coils 12 of the induction cooking hob 10. After all induction coils 12 of the induction cooking hob 10 have been identified, the initialization mode is finished by the control unit 20.

The initialization mode according to the present invention allows an association of the induction coils 12, which is independent of the electric connections to said induction coils 12. The unique number or identity for each induction coil 12 does not depend on the hardware of the induction cooking hob 10, but is defined by software stored in the non-volatile memory of the control unit 20.

Furthermore, the control system of the induction cooking hob 10 may include sensors, fans and/or actuators for tray and/or door movement. The electric motors of said actuators may work as generators and produce signals, which could be detected and assigned by the control unit 20 of the induction cooking hob 10. In this case only a single type of connector is possible for all different assembly groups of the induction cooking hob 10. The procedure mentioned above is also applicable to other components of the induction cooking hob 10 or a cooking oven, so that self-assigning modules are provided. Said self-assigning modules may be connected to the second communication bus 22, for example.

Moreover, optional recalibration programs may be considered useful for the user or for the after sales service. According to an example, a cooking vessel 16 of a certain size may be placed on different positions of the induction cooking hob. In this case, the user or the after sales service may be guided by a display of the induction cooking hob 10. By this way re-initialization mode may be performed.

FIG. 3 illustrates a schematic circuit diagram of the induction cooking hob 10 according to the prior art. The induction coils 12 of the induction cooking hob 10 are directly connected to the control unit 20. Each induction coil 12 has to be connected to the dedicated connector. With a high number of induction coils 12 wiring becomes complex and prone to errors.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 induction cooking hob
12 induction coil
14 user interface
16 cooking vessel
18 first communication bus
20 control unit
22 second communication bus
24 induction generator

What is claimed is:

1. A method for assigning a plurality of induction coils (12) of an assembled induction cooking hob (10) with a number or identity, so that each induction coil of the plurality of induction coils (12) corresponds with a number or an identity that is unique to the induction coil, wherein said method comprises the steps of:

a) providing the assembled induction cooking hob (10), including the induction coils (12) that, prior to the induction coils being assigned a unique number or identity at a control unit (20) for controlling the operation of the induction coils (12), are electrically connected to the control unit (20), b) setting a load onto the induction cooking hob (10), so that the load covers only a first one of the induction coils (12), c) activating a pot detection device for all induction coils (12) of the induction cooking hob (10), d) identifying by means of the pot detection device the first one of the induction coils (12) covered by the load, e) assigning to the first one of the induction coils covered by the load a unique number or identity, f) storing the unique number or identity assigned to the first one of the induction coils (12) covered by the load, g) setting the load onto the induction cooking hob (10), so that the load covers only a second one of the induction coils (12), h) repeating the steps c) to f) for the second one of the induction coils (12), and g) thereafter, repeating the steps b) to f) for all remaining induction coils (12) of the plurality of induction coils, with each induction coil (12) being assigned a number or identity that is unique to that induction coil (12), thereby allowing an association of the induction coils (12) with the control unit (20) to be made that is independent of the manner in which the induction coils are electrically connected to the control unit.

2. The method according to claim 1, characterized in that the load is a metal disk or a cooking vessel (16).

3. The method according to claim 2, characterized in that the area of the load has the same size as the induction coil (12).

4. An induction cooking hob (10) including a plurality of induction coils (12) and a control system, wherein:

the control system includes a control unit (20) and a pot detection device, the pot detection device is provided for detecting a load covering only one of the induction coils (12) at any time, the control unit (20) is provided for identifying the only one of the induction coils (12) covered by the load, the control unit (20) is provided for assigning a predetermined unique number or identity to the only one induction coil (12) covered by the load, the induction coils 12 having been electrically connected to the control unit (20) prior to the induction coils being assigned a predetermined unique number or identity, the control unit (20) is provided for storing the assigned unique number or identity in conjunction with the covered induction coil (12), the pot detection device is provided for repeating the detection of the load at each one of the induction coils (12), and the control unit (20) is provided for repeating the identification, assigning and storing of the unique numbers or identities in conjunction with each one of the induction coils (12) covered by the load.

5. The induction cooking hob according to claim 4, characterized in that the induction cooking hob (10) includes more than six induction coils (12).

6. The induction cooking hob according to claim 4, characterized in that the induction cooking hob (10) includes independent induction generators (24) for driving the induction coils (12), wherein the induction generator (24) is provided for driving one or more induction coils (12).

7. The induction cooking hob according to claim 6, characterized in that the induction generator (24) is a half-bridge inverter.

8. The induction cooking hob according to claim 6, characterized in that the induction coils (12) driven by one induction generator (24) are connected in series and/or in parallel.

9. The induction cooking hob according to claim 4, characterized in that the control system includes a communication bus (22) connecting the control unit (20) and the pot detection device.

10. The induction cooking hob according to claim 4, characterized in that the communication bus (22) connects the control unit (20) to the induction generators (24).

11. The induction cooking hob according to claim 4, characterized in that a further communication bus (18) connects the control unit (20) to a user interface (14).

12. The induction cooking hob according to claim 4, characterized in that the control system includes coordination means for synchronizing the induction generators (24).

13. The induction cooking hob according to claim 12, characterized in that the coordination means are provided for synchronizing the induction generators (24), so that induction coils (12) covered by the same cooking vessel (16) are driven by the same frequency.

14. The induction cooking hob according to claim 12, characterized in that the coordination means are provided for synchronizing the induction generators (24), so that neighboured induction coils (12) are driven by the same frequency.

* * * * *